United States Patent [19]

Tsutsumi

[11] 4,286,552

[45] Sep. 1, 1981

[54] VARIABLE COMPRESSION RATIO INTERNAL COMBUSTION ENGINE

[75] Inventor: Saburo Tsutsumi, Yokohama, Japan

[73] Assignee: Nissan Motor Company, Limited, Yokohama, Japan

[21] Appl. No.: 10,918

[22] Filed: Feb. 9, 1979

[30] Foreign Application Priority Data

Feb. 10, 1978 [JP] Japan ..... 53-14308

[51] Int. Cl.[3] ..... F02B 75/36

[52] U.S. Cl. ..... 123/48 AA; 123/78 AA; 123/48 B; 123/78 B

[58] Field of Search ..... 123/32 B, 48 R, 48 A, 123/48 AA, 48 B, 78 R, 78 A, 78 AA, 78 B, 119 A

[56] References Cited

U.S. PATENT DOCUMENTS 3,805,752 4/1974 Cataldo ..... 123/119 A
3,970,056 7/1976 Morris ..... 123/78 R

FOREIGN PATENT DOCUMENTS 1252965 10/1967 Fed. Rep. of Germany ..... 123/48 AA

*Primary Examiner*—Craig R. Feinberg

[57] ABSTRACT

The clearance volume of a combustion chamber of an internal combustion engine at the same crankangle is varied by changing the location of a small piston reciprocally disposed in a small cylinder formed in a cylinder head, which small cylinder communicates with an engine cylinder. Changing the location of the small piston is controllable through a link mechanism in response to the movement of a throttle valve for controlling the amount of intake air supplied to the combustion chamber.

3 Claims, 8 Drawing Figures

VARIABLE COMPRESSION RATIO INTERNAL COMBUSTION ENGINE

This invention relates to an internal combustion engine of the type wherein a substantial compression ratio is controllable to an optimum value by changing the volume of the combustion chamber at the same crank-angle in accordance with a particular engine operating parameter or parameters.

It is a main object of the present invention to provide an improved internal combustion engine which can overcome the disadvantages encountered in conventional internal combustion engines.

It is another object of the present invention to provide an improved internal combustion engine which has merits of both spark-ignition and compression-ignition engines, omitting demerits of the both engines.

It is still another object of the present invention to provide an improved internal combustion engine whose fuel consumption characteristic is nearly equal to a level of a compression-ignition engine, rendering engine weight, engine output power, engine noise and noxious gases emission to levels of the spark-ignition engine.

It is a further object of the present invention to provide an improved internal combustion engine in which the compression ratio at partial load operating range is made higher in order that the substantial compression pressure applied to the charge in the combustion chamber is made nearly equal to that at full load operating range.

It is a still further object of the present invention to provide an improved internal combustion engine which is not liable to raise engine knock and exhibits high thermal efficiency throughout whole engine operating ranges.

It is a still further object of the present invention to provide an improved internal combustion engine in which the compression ratio can be controlled by varying the volume of a combustion chamber at the same crank-angle in accordance with the charging efficiency of a inducted into the combustion chamber.

These objects, features and advantages of the engine according to the present invention will become more apparent from the following description taken in conjunction with the accompanying drawings.

Figure 1:
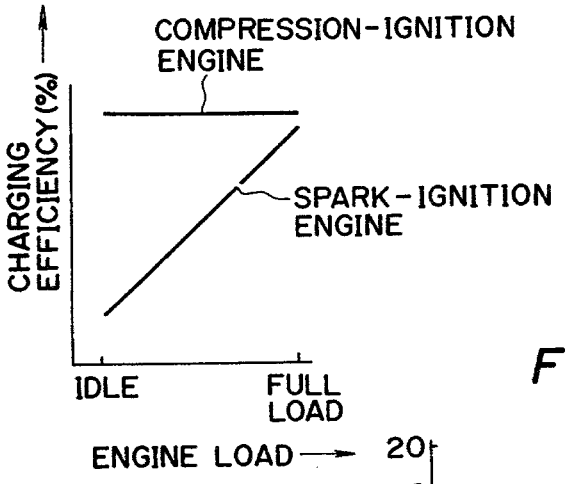
FIG. 1 is a graph showing the relationship between charging efficiency and engine load.
Figure 2:
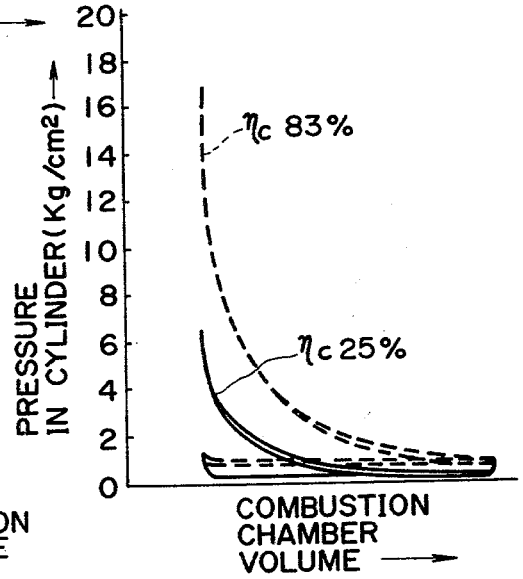
FIG. 2 is a graph showing the relationship between pressure variation in engine cylinder and combustion chamber volume variation during motoring wherein the charge in the combustion chamber is not burnt.

In a spark-ignition internal combustion engine, loads applied to the engine have been, in general, treated by changing the charging efficiency of a charge or a fluid inducted into the combustion chambers of the engine as shown in the graph of FIG. 1 of the drawings. The spark-ignition engine is in general such designed that the thermal efficiency at the maximum power output engine operating condition becomes high to prevent rise of shortcomings such as engine knock. Accordingly, when the engine is operated at a partial load operating condition, for example, at idling, substantial compression pressure is relatively low as indicated by solid curves in the graph of FIG. 2, which contributes to a considerable decrease in the thermal efficiency of the engine. In FIG. 2, the character $\eta_c$ represents a charging efficiency.

Figure 3:
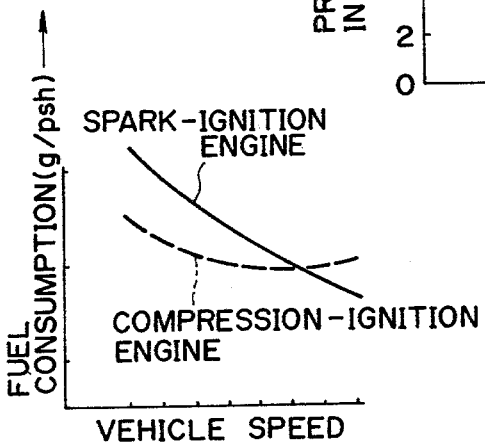
FIG. 3 is a graph showing the relationship between fuel consumption and vehicle speed under road-load operating condition.

In this regard, in a compression-ignition internal combustion engine (diesel engine), the charging efficiency of a charge inducted into the combustion chambers is nearly constant as shown in the graph of FIG. 1. Additionally, since loads applied to the engine are treated by changing the amount of fuel supplied to the engine, the substantial compression pressure to the charge becomes considerably high as indicated by broken curves in the graph of FIG. 2, which compression pressure is nearly the same as that of the spark-ignition engine at full load engine operating condition. Accordingly, the compression-ignition engine exhibits an excellent fuel consumption characteristic at partial load engine operating condition as seen from the graph of FIG. 3. However, such an excellent fuel consumption characteristic can not be always maintained at high load operating condition. At such a high load operating condition, a better fuel consumption characteristic may be obtained rather by the spark-ignition engine. In addition to the above, the compression-ignition engine has the following shrotcomings: the engine is considerably high in its operating pressure in the combustion chambers and therefore the weight of the engine is unavoidably increased. Engine power output relative to engine displacement is kept low since air inducted into the combustion chamber is not effectively used for combustion of fuel, causing increase in smoke amount in exhaust gases. Engine noise level is generally high. High precision machining is required for producing fuel injection pumps and nozzles and therefore production cost is high, which is not suitable for mass production. Combustion of fuel is achieved by scattered flame of sprayed fuel and therefore is carried out within stoichiometric air-fuel ratio, which increases the emission level of nitrogen oxides (NOx) which is difficult to decrease.

In addition to the above-discussed two kind of engines, a variable compression ratio engine has recently been proposed in which the compression ratio of the engine is variable in accordance with combustion pressure within the combustion chamber of the engine. However, such variable compression ratio engine has encountered a problem in which engine knock is liable to rise. Because, in case of the engine in which EGR is carried out to decrease the emission level of NOx, the amount of a fluid inducted into the combustion is large as compared with an engine without EGR and therefore the compression pressure is higher than in the engine without EGR.

In view of the above, the present invention contemplates to control the compression ratio of the engine by varying the volume of the combustion chamber in accordance with the charging efficiency of a charge inducted into the combustion chamber, in order to provide an internal combustion engine having merits of both the spark-ignition engine and the compression-ignition engine and to improve the conventional variable compression ratio engine.

Figure 4:
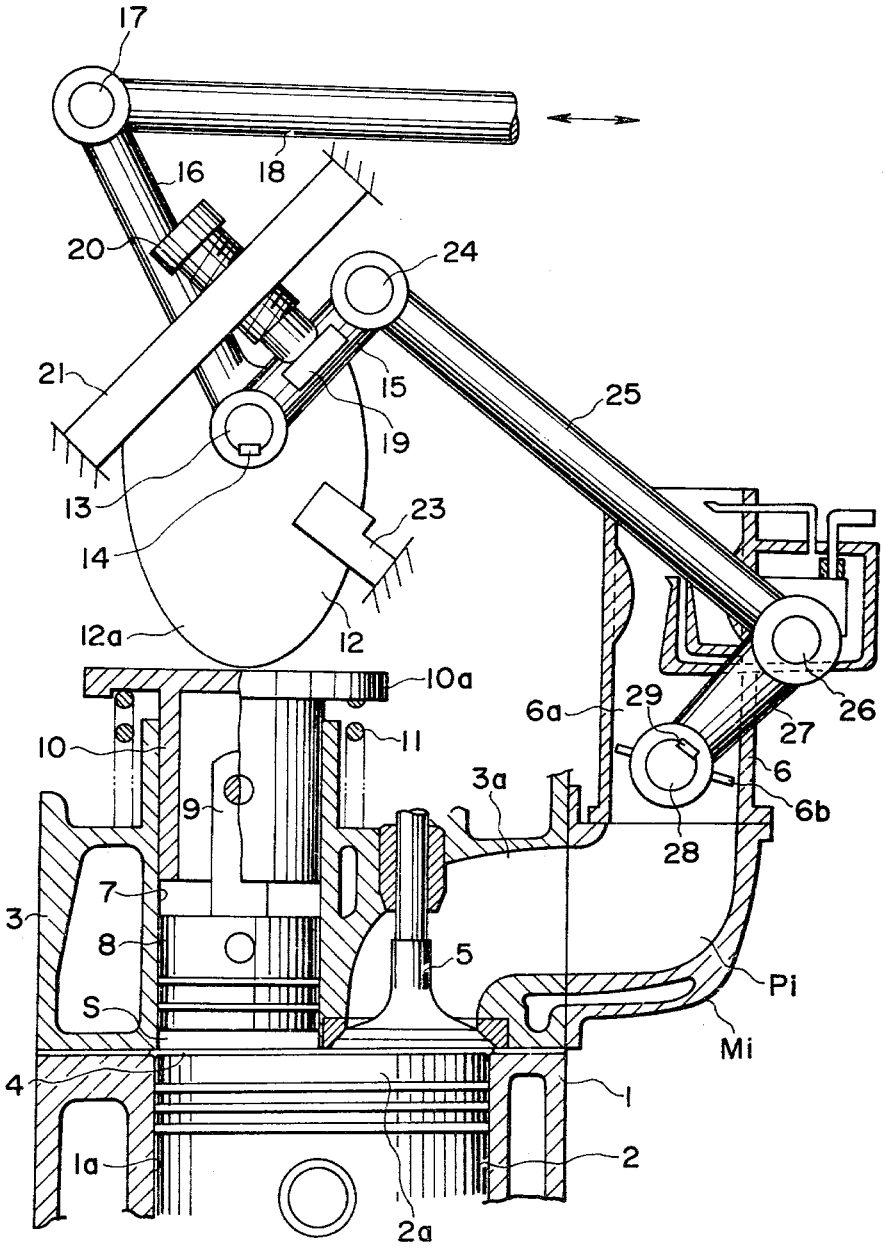
FIG. 4 is a schematic cross-sectional view of a first preferred embodiment of an internal combustion engine in accordance with the present invention.

Referring now to FIG. 4 of the drawings, there is shown a first preferred embodiment of an internal combustion engine in accordance with the present invention, in which the compression ratio thereof is variable in accordance with throttle position, in view of the fact that the variation of the throttle position corresponds to the charging efficiency of the engine. The engine of this instance is used for an automotive vehicle and comprises a cylinder block 1 which is formed therein with a cylinder 1*a* or cylinders in which a piston 2 or pistons are reciprocally movably disposed. Secured to the top surface of the cylinder block 1 is a cylinder head 3 which defines a combustion chamber 4 between it and the piston crown 2*a* of the piston 2. The cylinder head 3 is formed with an intake port 3*a* which is closable with an intake valve 5 which is seatable on a valve seat (no numeral) secured to or embedded in the cylinder head 3. The intake port 3*a* forms part of an intake passage $P_i$ through which a charge or air-fuel mixture is inducted into the combustion chamber 4. The intake port 3*a* is communicable through the intake valve 5 with the combustion chamber 4. The intake port 3*a* communicated through an intake manifold or a connecting hollow member $M_i$ with the air-fuel mixture induction passage 6*a* of a carburetor 6 which is, as usual, equipped with a throttle valve 6*b* which is rotatably disposed in the air-fuel mixture induction passage 5*a*.

The cylinder head 3 is further formed with a small cylinder 7 in which a small piston 8 is reciprocally movably disposed. A space S defined by the piston crown of the piston 8 and the cylindrical surface of the cylinder 7 forms part of the combustion chamber 4. The small piston 8 is connected through a connecting rod 9 with a cylindrical member 10 which is slidably disposed in the small cylinder 7. The cylindrical member 10 is formed at its top with a circular spring retainer 10*a*. A coil spring 11 is disposed between the annular portion (no numeral) of the spring retainer 10*a* and a surface of the cylinder head 3 so as to bias upward the connecting rod 9 in the drawing.

A cam 12 is such rotatably disposed that its cam lobe 12*a* is contactable on the flat surface of the circular spring retainer 10*a*. The cam 12 is integrally formed with a camshaft 13 which is rotatably supported by a supporting member (not shown). It will be understood that the cylindrical member 10 can be moved downward and upward with rotation of the cam 12. A cam arm 15 is secured on the camshaft 13 by means of a key 14 which is inserted in key grooves formed respectively in the camshaft 13 and in the end portion (no numeral) of the cam arm 15. Another cam arm 16 is also secured on the camshaft 13. The cam arm 16 may be integral with the camshaft 13 or otherwise secured by means of a key (not shown) as same as in the cam arm 15. The cam arm 16 is arranged to move around the camshaft 13 when a rod 18 is moved through a pin 17 in the directions indicated by a two headed arrow, in accordance with the movement, for example, of an accelerator or an acceleration pedal (no numeral).

The cam arm 15 is formed with a stopper 19 to which the tip of an idle adjustment screw 20 contacts to stop the cam arm 15 at a location suitable for engine idling. The adjustment screw 20 is rotatably retained by a screw retainer 21 which is secured to the cylinder head 3. The reference numeral 23 indicates a stop member to stop the rotational movement of the cam arm 15 upon contacting with stopper 19 when the throttle valve 6 is fully opened. The cam arm 15 is connected through a pin 24 with a rod 25 which is in turn connected through a pin 26 with a throttle arm 27. The throttle arm 27 is secured on a throttle shaft 28 by means of a key 29 which is inserted in grooves (no numerals) formed respectively in the throttle shaft 28 and in the throttle arm 27. It will be understood that the throtte valve 6*b* rotates to change the opening degree thereof with a rotational movement of the throttle arm 27.

The operation of the such arranged engine will be explained hereinafter.

During ilding of the engine, the throttle valve 6*b* is slightly opened to supply a necessary amount of air-fuel mixture by the action of the idle adjustment screw 20. At this moment, the cam 12 is such positioned that the most projected portion of the cam lobe 12*a* contacts with the flat surface of the circular spring retainer 10*a*, i.e., the lift of cam becomes the largest. Accordingly, the cylindrical member 10 is moved downward to the lowest position thereof, moving the small piston 8 to the lowest position thereof as shown in FIG. 4. As a result, the clearance volume of the combustion chamber 4 (or the volume of the combustion chamber 4 with the piston 2 on top dead center) becomes the smallest and therefore the mechanical compression ratio of the engine becomes the largest. However, since the opening degree of the throttle valve 6 is smaller and accordingly the charging efficiency of the charge (containing air, fuel, gas by EGR etc.) is considerably low, the substantial compression pressure acted on the charge is nearly equal to that at full throttle operating condition. It is to be noted that the charging efficiency is represented as follows: the charging efficiency=(the volume, converted at standard conditions, of gases actually supplied to the engine)/(the volume, at standard conditions, of air supplied to the engine, which volume is equal to the displacement of the engine). At the standard conditions, the temperature and the pressure are 20° C. and 760 mmHg, respectively. Additionally, the thermal efficiency of the engine at idling can be improved approximately to a level at full throttle operating condition.

When the acceleration pedal is depressed to move the rod 18 rightward in the drawing and the stopper 19 of the cam arm 15 strikes on the stop member 23, the throttle valve 6*b* is fully opened to maximize the charging efficiency of the air-fuel mixture supplied to the combustion chamber 4. Simultaneously, the cam 12 rotates clockwise to render the lift of cam the smallest and accordingly the cylindrical member 10 is pushed up by the action of the bias of the spring 11, locating the small piston 8 at the highest position thereof. As a result, the clearance volume of the combustion chamber 4 becomes the largest and the compression ratio becomes the smallest, and therefore the condition of combustion in the combustion chamber 4 becomes approximately equal to that at the full throttle operating condition in conventional engines. This can maximize the thermal efficiency of the engine without causing shortcomings such as engine knock.

When engine load is within a range from at idling to at full throttle, the position of the small piston is selected to obtain the compression ratio optimum for a charging efficiency determined in accordance with the opening degree of the throttle valve 6b. Therefore, the engine exhibits a high performance including high thermal effieicency, without causing engine knock etc.

FIG. 5 illustrates a second preferred embodiment of the internal combustion engine (no numeral) in accordance with the present invention, which is similar to the embodiment of FIG. 4 with the exception that the clearance volume of the combustion chamber can be varied by hydraulically controllably moving the piston crown. The engine of this instance is used in an automotive vehicle and comprises a cylinder block 101 in which a cylinder 101a or cylinders are formed. A cylinder head 102 is secured to the top surface of the cylinder block 101 and formed therein an intake passage $P_i$ which is closable with an intake valve 103. A throttle valve 104 is rotatably disposed in the intake passage $P_i$ to control the amount of the charge inducted into the engine. The throttle valve 104 may form part of a carburetor (not shown). The throttle valve 104 is arranged to be rotatably moved by a throttle wire 105 through a throttle wire guide 106.

A combustion chamber and combustion space 107 is defined between the bottom surface of the cylinder head 102 and the piston crown of a piston 108 which is reciprocally movably disposed in the cylinder 101a. The piston 108 is composed of a piston shell 108a which is formed thereinside with a cylindrical bore B. A cylindrical piston guide 109 is reciprocally and slidably disposed in the bore B. The piston guide 109 is formed with a large diameter portion 109a and a small diameter portion 109b which is smaller in outer diameter than the portion 109a. As shown, the large diameter portion 109a is slidably located in a large diameter portion $B_1$ of the bore B. The small diameter portion 109b of the piston guide 109 is slidably located in a small diameter portion $B_2$ of the bore B. A piston pin 110 is carried in the small diameter portion 109a of the piston guide 109. The upper end portion of a connecting rod 111 is rotatably mounted on the piston pin 110. A coil spring 112 is disposed in the cylindrical opening (no numeral) formed in the small diameter portion 109a of the piston guide 109, and its bottom portion is supported by an annular spring retainer 113 secured to the inner surface of the bottom portion of the piston shell 108a. The spring 112 functions to force the piston guide 109 upward relative to the piston shell 108a. As shown, a variable volume chamber 114 is formed between the inner surface of the top portion of the piston shell 108a and the outer surface of the top portion of the small diameter portion 109b of the piston guide 109. The chamber 114 communicates through a fluid passage 115 formed in the small diameter portion 109b with an annular groove 116 formed at the peripheral surface of the piston pin 110. The annular groove 116 communicates through a vertical fluid passage 117 with a laterally extending fluid passage 119. The fluid passage 119 is securely closed with a plug 118. The fluid passage 119 communicates through a vertical fluid passage 120 with an annular groove 121 formed on the outer peripheral surface of the piston pin 110. The groove 121 communicates with a straight fluid passage 122 formed through the connecting rod 111, which passage 122 in turn communicates through a hole 124 formed through a connecting rod bearing 123 with a fluid passage 125 which is formed in a crankshaft 126. The fluid passage 125 communicates through a hole 127a formed through a crankshaft main bearing 127 which is in turn communicates with a fluid passage 128 formed in the cylinder block 101. The fluid passage 128 communicates with a fluid (oil) gallery 129 formed in the cylinder block 101. The gallery 129 may extend vertically relative to the surface of the drawing and communicates through a connecting pipe 130 with a cylinder 131 forming part of a hydraulic pressure control system $S_h$. A piston 132 is slidably movably disposed in the cylinder 131 to separate the interior of the cylinder 131 into chambers A and B. The chamber A directly communicates with the conncecing pipe 130 as shown. The piston 132 is connected through a connecting rod 133 with a power piston 134 slidably disposed in a power cylinder 135. The piston 134 separates the interior of the cylinder 135 into chambers A' and B'. The chambers A' and B' communicate through two fluid passages 136 and 137, respectively, with a cylindrical opening (no numeral) in which a pilot valve 138 is slidably disposed. The pilot valve 138 includes three valve members 138a, 138b and 138c which are connected with each other so as to move as one body. A fluid passage 139a is provided to communicate between the cylindrical opening in which the pilot valve 138 is disposed and a pump 140 for pressuring a hydraulic fluid from a fluid reservoir 141, so that the cylindrical opening is supplied with the pressurized fluid from the pump 140. Fluid return passages 139b and 139c are provided to communicate the cylindrical opening in which the pilot valve 138 is disposed with the fluid reservoir 141, so that the hydraulic fluid in the cylindrical opening returns through the return passages 139b and 139c to the fluid reservoir 141. It will be understood that the pressurized fluid from the passage 139a can be selectively introduced into the chamber A' of the cylinder 135 through the passage 136 and into the chamber B' of the cylinder through the passage 137.

The reference numeral 142 indicates a pressure regulator valve assembly which communicates with the pump 140 to regulate the fluid pressure from the pump 140 within a certain range. The pressure regulator valve assembly 142 communicates through a fluid passage 143 with the pipe 130. A check valve 143a is disposed in the passage 143 adjacent the pipe 130 to allow the fluid in the passage 143 to flow only in the direction of an arrow indicated in the symbol of the check valve 143a.

The power piston 134 is connected through a connecting rod 144 with a first link mechanism including members 145 and 146. The pilot valve 138 is connected through a second link mechanism including members 147 and 148. The first and second link mechanisms are connected to a third link mechanism including members 149 to 159 inclusive as clearly shown in the drawing. The member 159 is connected to the acceleration pedal 160. Additionally, the throttle wire 105 is directly connected to the member 158 of the third link mechanism so that the opening degree of the throttle valve 104 is varied in accordance with the movement of the acceleration pedal 160. It will be appreciated that when the acceleration pedal 160 is depressed in the direction of a solid arrow, the members of the link mechanisms are moved in the directions indicated by solid arrows. On the contrary, when the acceleration pedal 160 is moved in the direction indicated by a broken arrow, the members of the link mechanisms are moved in the directions indicated by broken arrows.

The above-mentioned pressure regulator valve assembly 142 is arranged to vary the fluid pressure supplied to the fluid passage 143 within a certain range in accordance with the movement of the piston 134. Accordingly, the regulator valve assembly 142 is constructed as shown in FIG. 5B in which the regulator valve assembly 142 comprises a cylindrical casing 142*a*. A piston 142*b* is slidably disposed in the bore of the casing 142*a*. The piston 142*b* is formed with a generally disc portion $P_1$ and a pipe like portion $P_2$. The disc portion $P_1$ is slidably contact at its outer peripheral surface with the inner surface of the casing 142*a*. The pipe like portion $P_2$ is such integral with the disc portion $P_1$ that the upper section of the pipe like portion $P_2$ extends upward from the upper surface of the disc portion $P_1$ and the lower section of the pipe like portion $P_2$ extends downward from the lower surface of the disc portion $P_1$. As shown, the piston 142*b* separates the bore of the casing 142*a* into upper and lower chambers $C_1$ and $C_2$ which communicate with each other through a small opening 142*c*. The power chamber $C_1$ communicates with the pump 140 to be supplied with the pressurized fluid from the pump 140. The upper chamber $C_2$ communicates the fluid passage 143. The tip of the lower section of the pipe portion $P_2$ is seatable on a seat portion (no numeral) formed around an opening 142*d* which communicates with the fluid reservoir 141 to return the fluid in the lower chamber $C_1$ into reservoir 141. The upper section of the pipe like portion $P_2$ is slidably disposed in the inner surface of a cylindrical portion 142*e* which is projected vertically from the inner surface of the upper section of the casing 142*a*. The bore formed inside the cylindrical portion 142*e* is communicable with the opening 142*d* and the lower chamber $C_1$ through an elongate opening 142*f* formed through the pipe portion $P_2$ of the piston 142*b*. The cylindrical portion 142*e* has an opening 142*g* which is formed through the wall of the cylindrical portion 142*e*. The opening 142*g* is closable with a pilot valve 142*h* which is urged by the bias of a spring 142*i* secured to a movable rod member 142*j*. The rod member 142*j* is such connected to a connecting mechanism $M_c$ that the movable rod member 142*j* is moved rightward in the drawing when the constituting members (no numeral) of the connecting mechanism $M_c$ are moved in the direction indicated by solid arrows as shown in FIG. 5B.

With the thus arranged regulator valve assembly 142, the piston 142*b* floats at a level to maintain the pressure of the fluid from the pump 140 and accordingly a portion of the fluid supplied to the lower chamber $C_1$ may return to the fluid reservoir 141 through the opening 142*d* formed through the wall of the casing 142*a*. When the fluid pressure applied through the opening 142*c* of the piston 142*b* reaches a first certain level, the pilot valve 142*b* is moved to open the opening 142*g* to communicate the inside and outside of the cylindrical portion 142*e*. Then, the fluid in the outside of the cylindrical portion 142*e* is admitted through the opening 142*g* into the inside of the cylindrical portion 142*e*, thereafter the fluid is returned through the elongate opening 142*f* and the opening 142*d* to the fluid reservoir 141. Hence, the fluid pressure within the upper chamber $C_2$ is maintained at the desirable first certain level. However, when the connecting rod 133 is moved rightward in FIG. 5A, the movable rod 142*j* is moved rightward in FIG. 5B so that the fluid pressure within the upper chamber $C_2$ is maintained at a second certain level which is lower than the first certain level. On the contrary, when the connecting rod 133 is moved leftward in FIG. 5A, the fluid pressure within the upper chamber $C_2$ is maintained to a third certain level which is higher than the first certain level. It will be appreciated from the foregoing, that the fluid pressure produced by the action of the hydraulic piston 132 is variable within a range in accordance with the movement of the piston 134. By virtue of such pressure varying action of the regulator valve assembly 142, the fluid pressure within the variable volume chamber 114 of the piston 108 is maintained at a constant level, in consideration of leak etc. of the fluid in a hydraulic system of the engine.

The operation of the engine shown in FIG. 5A will be discussed hereinafter.

When the acceleration pedal 160 is depressed in the direction of the solid arrow to increase engine power output from no load engine operating condition or idling condition, the opening degree of the throttle valve 104 increases and the link mechanism are moved in the direction indicated by the solid arrows. Then, the pilot valve 138 is moved rightward in the drawing to communicate the passage 139*a* with the passage 136 and to communicate the passage 137 with the passage 139*c*. As a result, the chamber A' of the cylinder 135 is supplied with pressurized fluid from the pump 140 and the fluid in the chamber B' of the cylinder 135 is returned to the reservoir 141. This causes the power piston 134 to move rightward in the drawing or in the direction of the solid arrow indicated in the chamber A', which moves the piston 132 in the cylinder 131 in the direction of the solid arrow indicated in the chamber B. Accordingly, the volume of the chamber A increases to decrease the fluid pressure in the pipe 130, the fluid gallery 129 and the fluid passage 128. As a result, the fluid pressure within the variable volume chamber 114 in the piston 108 is decreased to move the piston shell 108*a* downward relative to the piston guide 109 by the bias of the spring 112, decreasing the height H of the variable volume chamber 114 or the distance between the inner surface of the top portion of the piston shell 108*a* and the outer surface of the top portion of the piston guide 109. Therefore, the clearance volume of the combustion chamber 107 or combustion space is increased to decrease the mechanical compression ratio of the engine.

On the contrary, when the acceleration pedal 160 is returned to the direction of the broken arrow by the bias of a spring (no numeral), the opening degree of the throttle valve 104 is decreased or closed and the link mechanisms are moved in the directions of broken arrows to move the pilot valve 138 leftward in the drawing. Then, the passage 139*a* with the passage 137 to supply the pressurized fluid from pump 140 into the chamber B', and the passage 139*b* communicates with the passage 136 to return the fluid in the chamber A' into the reservor 141. This causes the power piston 134 to move in the direction of a dotted arrow indicated in the chamber A', moving the piston 132 in the direction of a dotted arrow indicated in the chamber B of the cylinder 131.

As a result, the fluid pressure within the variable volume chamber 114 in the piston 108 is raised so that the height H of the chamber 114 is increased to move the piston shell 108*a* upward relative to the piston guide 109 against the bias of the spring 112. Then, the clearance volume of the combustion chamber 107 is decreased to increase the mechanical compression ratio of the engine.

It will be understood that the clearance volume of the combustion chamber 107 can be controlled to an optimum value in accordance with the amount of charge (containing air, fuel and EGR gas) inducted into the combustion chamber which amount is determined by the opening degree of the throttle valve 104 which is moved with the movement of the acceleration pedal 160. Additionally, since the thus controlled compression ratio of the engine becomes nearly the same as that at full throttle operating condition of the conventional engine, the combustion efficiency of the engine at such a compression ratio can be maintained nearly at a level same as at full throttle operating condition in the conventional engine, preventing rise of shortcomings ssuch as engine knock.

It is to be noted that, with such an arrangement to vary the combustion chamber volume by moving the piston crown, a wide range of variation of the compression ratio becomes possible even though the moving amount of moving parts is less. Furthermore, the locations of intake and exhaust valves, a spark plug and a fuel injection nozzle on the cylinder head side are not restricted and therefore an ideal combustion chamber construction can be obtained.

Figure 5A:
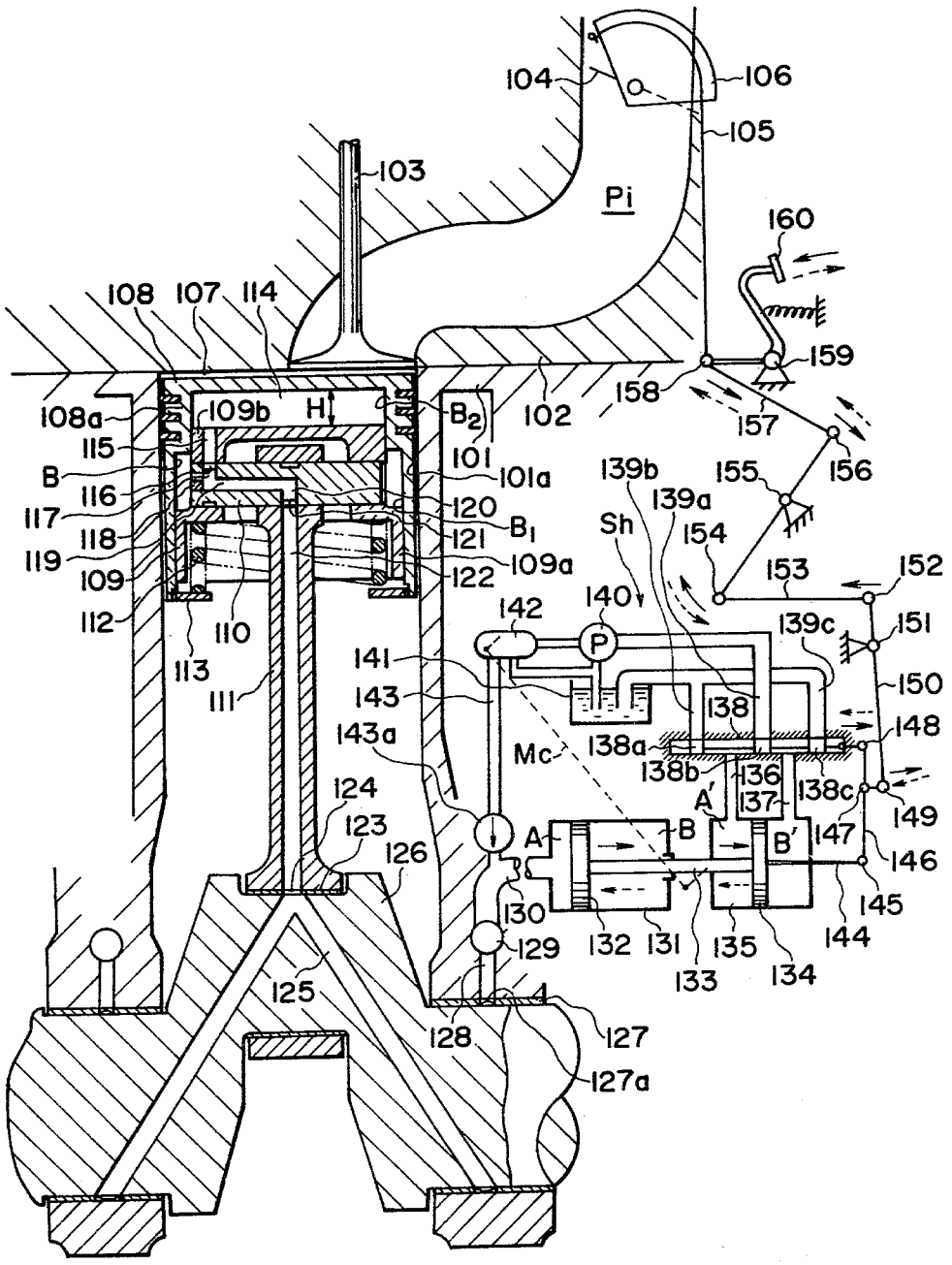
FIG. 5A is a schematic cross-sectional view of a second preferred embodiment of the engine in accordance with the present invention.
Figure 5B:
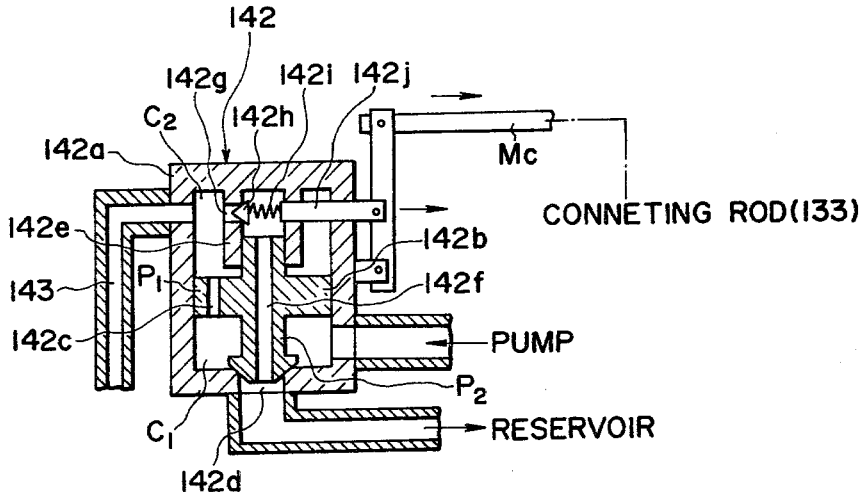
FIG. 5B is a schematic cross-sectional view of a pressure regulator valve assembly used in the engine of FIG. 5A.
Figure 6:
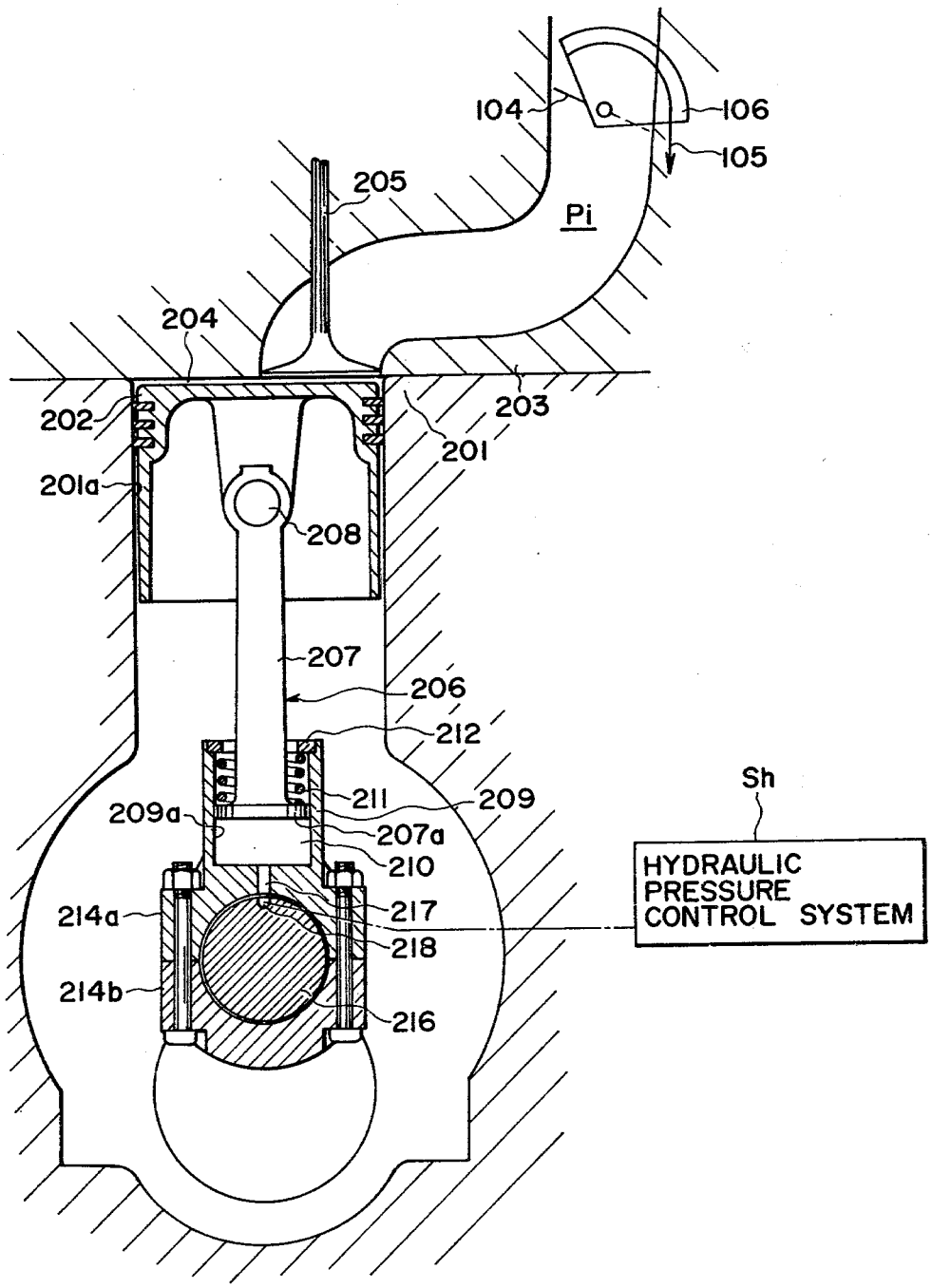
FIG. 6 is a schematic cross-sectional view of a third embodiment of the engine in accordance with the present invention.

FIG. 6 illustrates a third preferred embodiment of the internal combustion engine (no numeral) in accordance with the present invention, which is similar to the embodiment of FIG. 5 with the exception that the clearance volume of combustion chamber is varied by changing the axial length of a section corresponding to a connecting rod. Accordingly, like reference numerals are assigned to like parts and elements for the purpose of simplicity of description. The engine of this instance is used for an automotive vehicle and comprises a cylinder block 201 which is formed therein with a cylinder 201*a* or cylinders. A piston 202 is reciprocally movably disposed in the cylinder 202. A cylinder head 203 is secured to the top surface of the cylinder block 201 to define a combustion chamber or space 204 between its bottom surface and the crown of the piston 202. The cylinder head 203 is formed with the intake passage $P_i$ for introducing therethrough a charge or air-fuel mixture into the combustion chamber 204. The intake port $P_i$ is closable with an intake valve 205 as usual.

The throttle valve 104 is rotatably disposed in the intake passage $P_i$ which can be rotated through the throttle wire 105 and the throttle wire guide 106 by the acceleration pedal 160 (not shown). It is to be noted that the relationship between the throttle valve 104 and the acceleration pedal is the same as in the embodiment of FIG. 5A.

A connecting rod assembly 206 is composed of a straight elongate rod 207 which is mounted at its one end on a piston pin 208 which is inserted in the piston 202. The elongate rod 207 is formed at the other end thereof with a connecting rod piston 207*a* which is slidably and reciprocally disposed in a connecting rod cylinder 209*a* formed by a cylindrical wall portion 209. A variable volume chamber 210 is formed between the piston 207*a* and the bottom surface of the cylinder 209*a* and an annular spring retainer 212 which is secured to the inner peripheral surface of the cylindrical wall portion 209. The spring 211 functions to force the cylinder 202 downward in the drawing or in the direction for increasing the clearance volume of the combustion chamber 204. The cylindrical wall portion 209 is formed integrally with an upper receiving portion 124*a* which receives a crankshaft 216 in cooperation with a lower receiving portion 214*b*. As shown, the upper and lower receiving portions 214*b* are secured to each other by means of bolts (no numerals). The chamber 210 communicates through a fluid passage 217 formed through the upper receiving portion 214*a* with a fluid passage 218 which is formed in the crankshaft 216. The fluid passage 218 communicates with the fluid passage 128 formed in the cylinder block 210. It is to be noted that an operative connection between the throttle valve and the passage 128 through the hydraulic pressure control system $S_h$ is the same as in the embodiment of FIG. 5A and therefore the connection therebetween is omitted.

In operation, when the engine is operated at idling or no engine load operating condition, the throttle valve 104 associated with the acceleration pedal 160 is fully closed and accordingly the smallest amount of the charge is inducted into the combustion chamber 204. Then, the fluid pressure in the fluid passage 218 is increased by the action of the hydraulic pressure control system $S_h$ operated in accordance with the movement of the throttle valve 104. Accordingly, the fluid pressure in the variable volume chamber 210 is increased to move the piston 207*a* upward in the drawing or in the direction to increase the volume of the chamber 210, overcoming the bias of the spring 211. The crown of the piston 202 is then pushed up to the most highest position in the cylinder 201*a*, minimizing the clearance volume of the combustion chamber 204 and the charging efficiency. As a result, the compression pressure in the combustion chamber with the piston on top dead center is increased nearly to a level at full throttle operating condition of the conventional engine, and the thermal efficiency of the engine is maintained at a high level, improving fuel consumption characteristic to a considerable extent.

A high load engine operating condition, the throttle valve is widely opened to increase the charging efficiency of the charge into the combustion chamber 204. Simultaneously, the fluid pressure of a fluid supplied to the fluid passage 217 is lowered by the action of the hydraulic pressure control system $S_h$ operated in accordance with the movement of the throttle valve 104. Accordingly, the connecting rod piston 207 is moved downward in the drawing or in the direction to decrease the volume of the variable volume chamber 210, by the action of the bias of the spring 211. Then, the crown of the piston 202 is moved downward in the drawing to increase the clearance volume of the combustion chamber 204. As a result, the compression pressure acted on the charge in the combustion chamber is maintained at a necessary high level although the mechanical compression ratio is lowered, because of the increased charging efficiency. Hence, the thermal efficiency of the engine is maintained high, preventing engine knock.

Now, it is to be noted that the opening degree of the throttle valve correlates with the charging efficiency of the charge inducted into the combustion chamber in the relationship of approximately 1:1. Also in an engine in which exhaust gas recirculation (EGR) is carried out, the compression ratio of the engine can be controlled to an optimum value, because EGR rate (the volume of EGR gas relative to the amount of intake air) is previously scheduled in accordance with engine loads and is in relation to throttle position or the opening degree of the throttle valve. For example, when the amount of EGR gas is larger, the compression ratio of the engine should be lowered below that in case of no EGR. Because, in case of EGR gas amount being larger, the opening degree of the throttle valve becomes larger to increase the charging efficiency of the engine even under the same engine load opening condition. Furthermore, the intake vacuum of the engine correlates to the engine load in the relationship of approximately 1:1. Additionally, an additional fluid such as EGR gas is supplied to the intake air, the absolute pressure in the intake passage is increased and the intake vacuum well correlates to the charging efficiency of the charge inducted into the engine. Moreover, in case of employing a turbocharger which is often provided in a diesel engine, the intake vacuum is pressurized to exhibit a positive pressure and therefore it can be easily and clearly detected that the charging efficiency of the engine has been further increased.

It will be understood that the charging efficiency of the engine can be further precisely detected by using a fluid flow sensor which is constructed and arranged to sense the flow amount of the charging fluid inducted into the engine.

Engines are in general equipped at its exhaust system with a muffler, exhaust gas purifying device etc. which are disposed in an exhaust passage. It will be understood that the exhaust pressure within the exhaust passage increases with an increase in charging efficiency of the engine and accordingly the charging effificiency of the engine can be precisely detected by sensing the exhaust gas pressure within the exhaust passage.

In the spark-ignition internal combustion engine, the vacuum generated at a venturi of a carburetor increases with an increase in the charging effieiency of the engine and therefore the charging efficiency of the engine can be precisely detected also by sensing the venturi vacuum.

In addition to the above-mentioned methods, the charging efficiency of the engine can be further precisely detected by sensing engine speed and the amount of intake air inducted into the engine and thereafter calculating the charging efficiency of the engine by using the sensed engine speed and intake air amount. In order to calculate the charging efficiency of the engine in such a method, the engine speed and the intake amount are firstly converted into electric signals corresponding to them, respectively, and thereafter these electric signals supplied to a central pressing unit forming part of a control circuit such as a microcomputer to determine the charging efficiency of the engine in accordance with the electric signals corresponding to the engine speed and the intake air amount. In accordance with the determined charging efficiency, an optimum compression ratio of the engine is further determined. In such a method, flow amount of the charging fluid inducted into the engine can be sensed by a pressure sensor for sensing the pressure within an intake passage through which intake air is introduced into the combustion chamber; by an air flow sensor for sensing the flow amount of intake air inducted into the combustion chamber; by EGR gas flow sensor for sensing the flow amount of EGR gas inducted into the combustion chamber; by a venturi vacuum sensor for sensing venturi vacuum in a carburetor; by an exhaust gas pressure sensor for sensing the exhaust gas pressure within the exhaust gas passage through which exhaust gas from the combustion chamber is discharged out of the engine; and by a throttle position sensor for sensing the opening degree of the throttle valve of the engine. Such a method of detecting the charging efficiency of engine can be achieved, for example, by the arrangement shown in FIG. 7.

Figure 7:
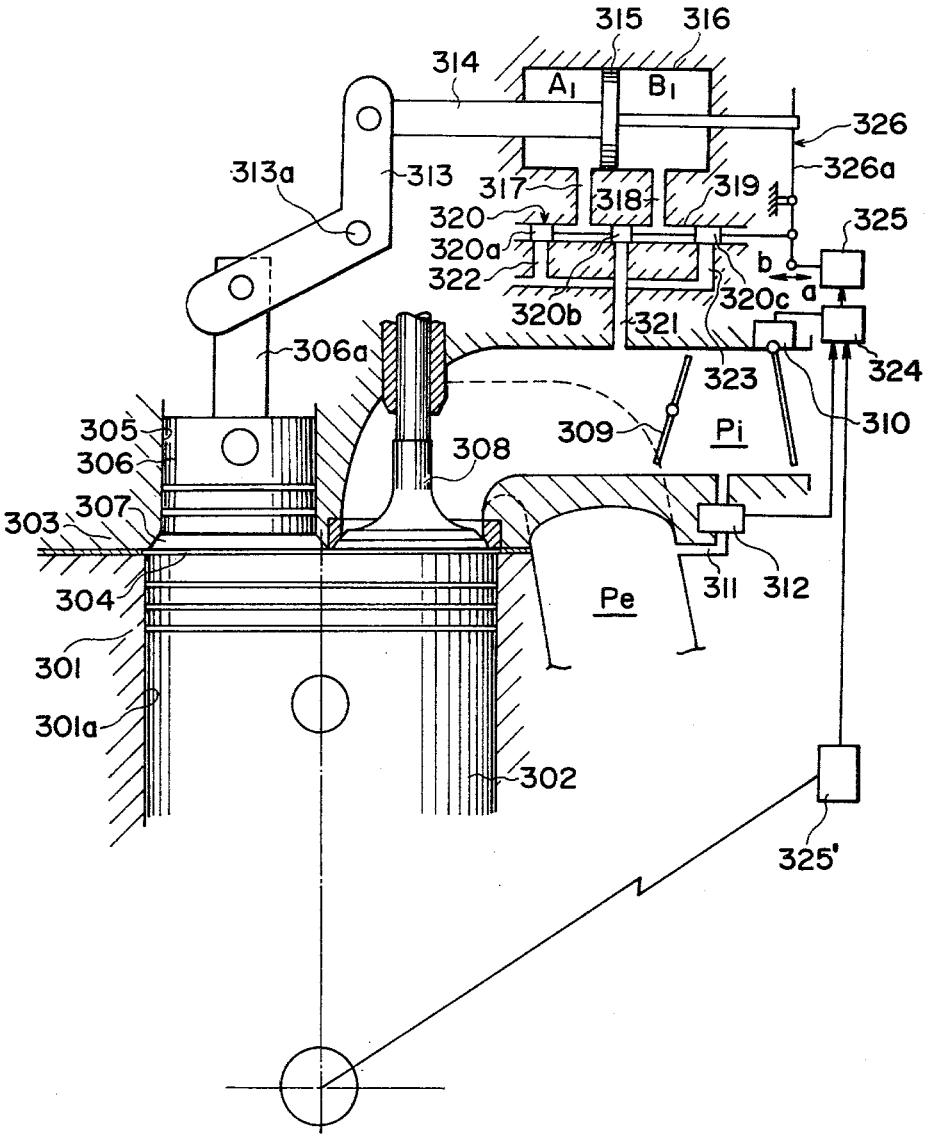
FIG. 7 is a schematic cross-sectional view of a fourth preferred embodiment of the engine in accordance with the present invention.

FIG. 7 illustrates a fourth embodiment of the internal combustion engine in accordance with the present invention, which is similar to the embodiment of FIG. 4 with the exception that the clearance volume of a combustion chamber is varied in cooperation of a hydraulic control system (no numeral) and an electronic control system (no numeral). The engine (no numeral) of this instance is used for an automotive vehicle and comprises an engine block 301 which is formed therein with a cylinder 301*a* or cylinders. A piston 302 is reciprocally movably disposed in the cylinder 301*a*. A cylinder head 303 is secured to the top surface of the cylinder block 301 to define a combustion chamber 304 or space between its bottom surface and the crown of the piston 302. The cylinder head 303 is formed with a small cylinder 304 in which a small piston 305 is reciprocally movable disposed. As shown, the piston 306 defines a space 307 under its crown or the bottom surface, which space 307 forms part of the combustion chamber 304. The engine is formed with an intake passage $P_i$ which is communicable through an intake valve 308 with the combustion chamber 304. The combustion chamber 304 is supplied with a charge or air-fuel mixture inducted through the intake passage $P_i$. An air flow sensor 310 is disposed to sense the flow amount of intake air inducted into the combustion chamber 304.

An exhaust passage $P_e$ communicable with the combustion chamber 304 is provided, as usual, to discharge exhaust gases or combustion gases out of the engine. An EGR passage 311 is provided to connect the exhaust passage $P_e$ and the intake passage $P_i$ to supply a portion of the exhaust gases flowing through the exhaust passage $P_e$ into the intake passage $P_i$ in order to recirculate the exhaust gases back to the combustion chamber 304. The reference numeral 312 indicates an EGR control valve for controlling the amount of the exhaust gases supplied to the intake passage $P_i$, which valve 312 also serves as an EGR gas flow sensor which is constructed and arranged to sense the flow amount of the exhaust gases passing through the EGR passage 311.

The small piston 306 is provided with a piston rod 306*a* which is mechanically connected through a link mechanism 313 to a piston rod 314 of a piston 315. The piston 315 is slidably movably disposed in a cylinder 316. The piston 315 is moved in the cylinder 136 by the pressure difference between intake vacuum in the intake passage $P_i$ and the atmospheric pressure. The piston 315 separates the interior of the cylinder 316 into two chambers $A_1$ and $B_1$. The chambers $A_1$ and $B_1$ communicate through passages 317 and 318, respectively, with an elongate opening 319. A spool-type pilot valve 320 is slidably disposed within the opening 319. The pilot valve 320 is provided with three valve members 320*a*, 320*b* and 320*c*. As shown, the opening 319 communicates at its central portion with the intake passage $P_i$ through a passage 321, and at its both ends thereof with ambient air through passage 322 and 323.

A control circuit 324 includes a central pressing unit such as a micro-processor for treating various input or information signals to produce control or command signals. The control circuit 324 is constructed and arranged to generate electric signals corresponding to the charging efficiency of the charge inducted into the combustion chamber in accordance with an electric signal representing the intake air flow amount which signal is supplied from the air flow sensor 310, an electric signal representing the EGR gas flow amount which signal is supplied from the EGR gas flow sensor 312, and an electric signal representing the engine speed which signal is supplied from the engine speed sensor 325'. Accordingly, the control circuit 324 is electrically connected to the air flow sensor 310, EGR gas flow sensor 312, and the engine speed sensor 325.

An actuator 325 is electrically connected to the control circuit 324 and constructed and arranged to actuate the pilot valve 320 through a link mechanism 326 in accordance with the electric signals from the control circuit 314. The link mechanism 326 includes a straight rod 326*a* which is swingably supported by a supporting member (no numeral). As shown, the piston 315 and the pilot valve 320 connected respectively at the opposite sides of the straight rod 326*a* relative to the supported portion of the rod 326*a*.

In operation, when the engine is operated under a condition in which the charging efficiency is relatively low, the control circuit 324 generates the electric signal for causing the actuator 326 to move the pilot valve 320 in the direction of an arrow head a. Then, the pilot valve 320 is put into a position wherein the passage 317 communicates with the passage 321 and the passage 318 communicates with the passage 323. As a result, the chamber $A_1$ of the cylinder 136 is supplied with an intake vacuum from the intake passage $P_i$, whereas the chamber $B_1$ of the cylinder 316 is supplied with atmospheric air from the passage 323. Accordingly, the piston 315 is moved leftward in the drawing, rotating the link mechanism 313 anticlockwise around a pin 313*a*. This moves the piston 306 downward in the drawing to decrease the volume of the space 307, decreasing the clearance volume of the combustion chamber 304. As a result, the compression ratio of the engine becomes higher and therefore the thermal efficiency of the engine is improved.

On the contrary, when the engine is operated under a condition wherein the charging efficiency of the engine is relatively high, the control circuit 324 generates the electric signal for causing the actuator 325 to move the pilot valve 320 in the directin of an arrow head b, by which the pilot valve is put into a position wherein the passage 317 communicates with the passage 322 and the passage 318 communicates with the passage 321. Then, the chamber $A_1$ is supplied with atmospheric air, whereas the chamber $B_1$ is supplied with the intake vacuum from the intake passage $P_i$. Accordingly, the cylinder 315 is moved rightward, rotating the link mechanism 312 clockwise around the pin 313*a*. This causes the piston 306 to move upward in the drawing, increasing the volume of the space 307. As a result, the clearance volume of the combustion chamber 304 decreases.

It will be appreciated that the link mechanism 313 is effective for controlling the clearance volume of the combustion chamber in an engine of the type wherein the volume of the combustion chamber is variable by moving a small piston which is provided to deform the combustion chamber in cooperation with a main piston which is connected to the crankshaft of the engine, as shown in FIGS. 4 and 7. The link mechanism 313 is simple in construction and convenient in operation since it is actuable without using a hydraulic pressure source.

It will be further appreciated that the hydraulic pressure control system $S_h$ is effective for controlling the clearance volume of the combustion chamber in an engine of the type wherein the volume of the combustion chamber is variable by moving the location of piston crown relative to a piston pin as shown in FIG. 5A, or by changing the length of a section corresponding to a connecting rod as shown in FIG. 6.

It is to be noted that, in the embodiment of FIG. 7, the intake vacuum in the intake passage $P_i$ is used to control an actuating device for actuating the small piston 306. The intake vacuum is effective from view points of simplifying construction and lowering production cost since the intake vacuum exists in all types of internal combustion engines.

In both spark-ignition engines and compression-ignition engines, an increase in maximum power output and a decrease in weight and size can be achieved even at the same displacements, by compressing intake air supplied to the combustion chamber by means of a supercharger. However, in such cases, the charging efficiency of the charge is increased to increase the substantial compression ratio of the engine and therefore engine knock is liable to rise. In order to solve this problem, it is effective to vary the compression ratio of the engine in accordance with the charging efficiency which is sensed by suitable means. For example, when the intake air is compressed by the supercharger, the compression ratio should be lowered since the charging efficiency becomes higher. This invites advantages in which high octane number fuel is not necessarily required. As the supercharger, one directly connected to the engine, a turbocharger, or other types of supercharger can be used.

In the case in which a spark-ignition engine is operated on a fuel having an octane number ranging from 87 to 92, the compression ratio of the engine is set nearly at 8:1 or 9:1 and the charging efficiency of the charge at full throttle becomes nearly 80%. Engine knock does not rise and the thermal efficiency of the engine is the best under such a condition and therefore the upper limit of the compression ratio is determined under such a condition.

The thermal efficiency of the engine is nearly 20 to 25% at idling though it dependent on engines, and therefore the lower limit of the compression ratio of the engine is determined at idling. It will be understood that the range of the compression ratio set for an engine varies dependent on fuels supplied to the engine. In this regard, the compression ratio can be made high by 1 or 2 in the engine which mainly uses a fuel having a relativey high octane number. On the contrary, the compression ratio is necessary to be set at a relatively low value in the engine which mainly uses a low quality fuel having a relatively low octane number.

In the compression-ignition engines, if indirect fuel injection is employed in which fuel is injected through a swirl chamber or pre-chamber, the compression ratio is set at about 23:1, and if a direct fuel injection to a combustion chamber is employed, the compression ratio is such set that is lower limit lies at about 12:1. When the charging efficiency of the engine becomes higher by compressing intake air with the supercharger, the compression ratio of the engine is lowered to prevent an excessive rise in the compression pressure in the combustion chamber. This provides an improved diesel engine in which fuel consumption is better and engine noise level is considerably low.

As appreciated from the foregoing discussion, the engine according to the present invention can exhibit the following significant advantates:

(1) Since the compression ratio of the engine is controllable in accordance with the charging efficiency of the engine, the fuel consumption of the engine at partial load operating range can be improved nearly to a level at full throttle operating range.

(2) The fuel consumption throughout whole engine operating ranges is improved without setting the compression ratio at the maximum power output engine operating range at a too high value. Accordingly, unstable combustion such as engine knock and preignition does not rise, which contributes to decrease in generation of engine noise.

(3) Since the compression ratio of the engine is lowered to a relatively low level, it becomes possible to use a relatively low quality fuel, and additionally the deterioration of fuel consumption does not occur at a partial load engine operating range.

(4) The compression pressure and the temperature within a combustion chamber at engine starting is approximately the same as at full throttle operating range. Accordingly, a stable combustion on a lean air-fuel mixture can be effectively achieved even at idling and low load engine operating range, improving the fuel consumption and decreasing the emission levels of noxious gases such as carbon monoxide (CO), hydrocarbons (HC) and nitrogen oxides (NOx).

(5) In case in which EGR is carried out, the charging efficiency of the engine increases by an amount corresponding to the amount of EGR gas as a matter of course. In this regard, the compression ratio control system (dependent on charging efficiency) according to the present invention is effective to control the compression pressure on top dead center to an optimum level to prevent the rise of engine knock, as compared with other compression ratio control systems which vary the compression ratio in dependence on engine loads.

It will be understood from the foregoing description, that the principle of the present invention is applicable to internal combustion engines such as spark-ignition engines, compression-ignition engine, four-stroke cycle engines, two-stroke cycle engines, reciprocating-piston engines, and rotary combustion chamber engines, and to combinations of the above-mentioned various internal combustion engines.

What is claimed is:

1. A reciprocating piston internal combustion engine having an engine cylinder, comprising:

a piston reciprocally movable disposed in the cylinder to define a combustion chamber between a crown of said piston and a cylinder head;

means for varying the clearance volume of the combustion chamber, when actuated; said varying means including a small cylinder formed in the cylinder head, and a small piston in said small cylinder, the crown of said small piston defining a space in the small cylinder, said space forming part of the combustion chamber, said small piston being smaller in diameter than the engine cylinder;

means for detecting the charging efficiency of a charge inducted into the combustion chamber, said detecting means including means for determining the charging efficiency by sensing the amount of fluid to be charged into the combustion chamber and sensing an engine operating parameter, said determining means including an air flow sensor for sensing the flow amount of fluid to be inducted into the combustion chamber, an engine speed sensor for sensing engine speed, and EGR gas flow sensor for sensing the flow amount of EGR gas passing through an EGR passage connecting an intake passage and an exhaust passage through which exhaust gas from the combustion chamber is discharged out of the combustion chamber, and a control circuit for determining the charging efficiency in accordance with the information signals from said air flow sensor, said engine speed sensor and said EGR gas flow sensor to generate command signals, means for modifying intake vacuum in accordance with the charging efficiency detected by said detecting means, said modifying means being operated in response to the command signals from said control circuit of said detecting means; and means for controllably actuating said varying means in response to the modified intake vacuum by said modifying means, said actuating means including a hydraulic piston slidably disposed in a cylinder to separate the interior of the cylinder into first and second chambers, the first and second chambers being communicable with an intake passage through which intake air is inducted into the combustion chamber in order that the first and second chambers are selectively supplied with intake vacuum in the intake passage, and a connecting mechanism for so connecting said hydraulic piston with said small piston that the volume of said space in said small cylinder varies with the movement of said hydraulic piston.

2. A reciprocating piston internal combustion engine as claimed in claim 1, in which said modifying means includes a pilot valve for introducing the intake vacuum from the intake passage selectively into the first and second chambers of said hydraulic cylinder, when moved, and a pilot valve actuator for moving said pilot valve in response to signals from said determining means.

3. A reciprocating piston internal combustion engine as claimed in claim 2, wherein said determining means is operatively connected to said pilot valve actuator for generating command signals operating said pilot valve actuator.

* * * * *